United States Patent [19]

Demler et al.

[11] 4,159,081

[45] Jun. 26, 1979

[54] PLURAL VALVE, HAND-HELD SPRAY APPARATUS

[75] Inventors: Roger L. Demler, Sherborn; Joseph Gerstmann, Sudbury, both of Mass.

[73] Assignee: Scientific Energy Systems Corporation, East Natick, Mass.

[21] Appl. No.: 816,651

[22] Filed: Jul. 18, 1977

[51] Int. Cl.[2] ..... B05B 11/02

[52] U.S. Cl. ..... 239/323; 222/630; 239/415

[58] Field of Search ..... 222/95, 193, 386.5, 222/399, 472, 473, 474, 509, 518; 239/323, 414, 415, 416.2, 527

[56] References Cited

U.S. PATENT DOCUMENTS

| | | | |
|---|---|---|---|
| 1,981,077 | 11/1934 | Shields | 239/414 X |
| 2,550,888 | 5/1951 | Traughber | 239/414 X |
| 2,868,585 | 1/1959 | Esser | 239/527 X |
| 3,255,972 | 6/1966 | Hultgren | 239/323 X |

*Primary Examiner*—Robert J. Spar
*Assistant Examiner*—Fred A. Silverberg
*Attorney, Agent, or Firm*—Edgar H. Kent

[57] ABSTRACT

Dispensing apparatus has a body defining therein a tubular chamber with an outer wall of generally circular cross-section. A generally coaxial discharge orifice at an end of this chamber is closed by a first valve that includes a member of generally circular cross-section. That member also forms an inner chamber wall and defines with the outer chamber wall an annular discharge passage that is convergent towards the discharge orifice. An annular outlet is in one of the chamber walls and first passage is arranged to supply liquid to be dispensed to the annular outlet for discharge into the discharge passage. Second passage is provided for directing gas under pressure into the chamber for flow through the discharge passage, past the annular outlet and out the orifice. A second valve in the body seals the second passage from the chamber, and an operator mechanism is provided for operating the first and second valves concurrently to open the discharge orifice and to allow gas under pressure to flow through the annular outlet through the discharge orifice and form a spray of generally conical pattern.

18 Claims, 18 Drawing Figures

FIG 1
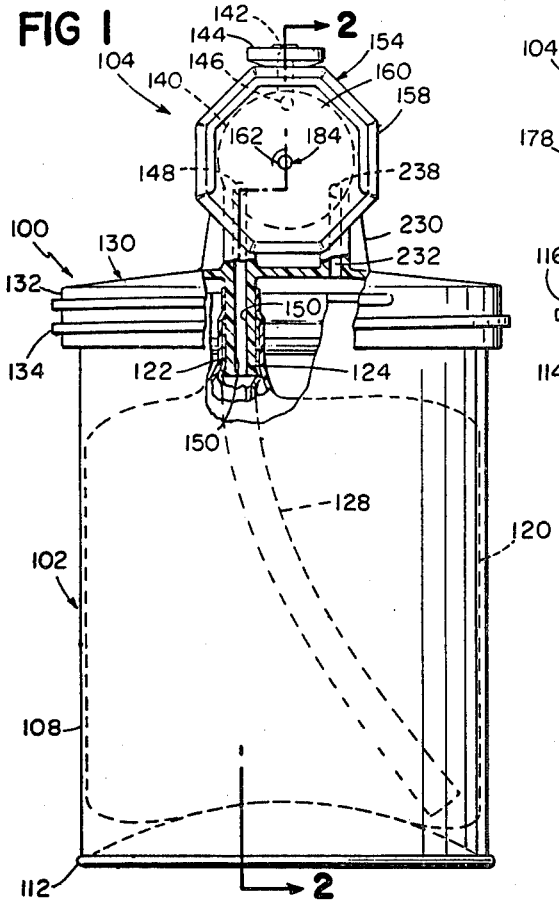
FIG 2
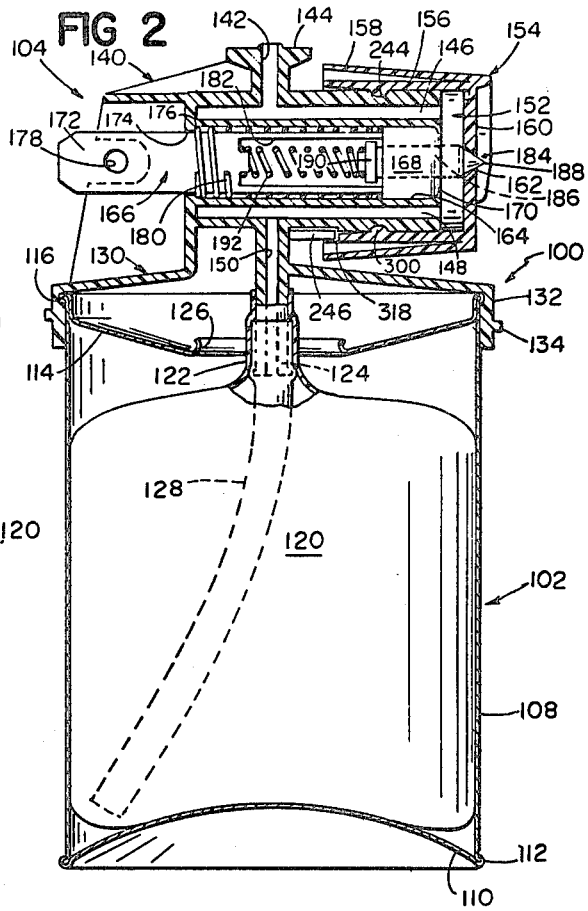
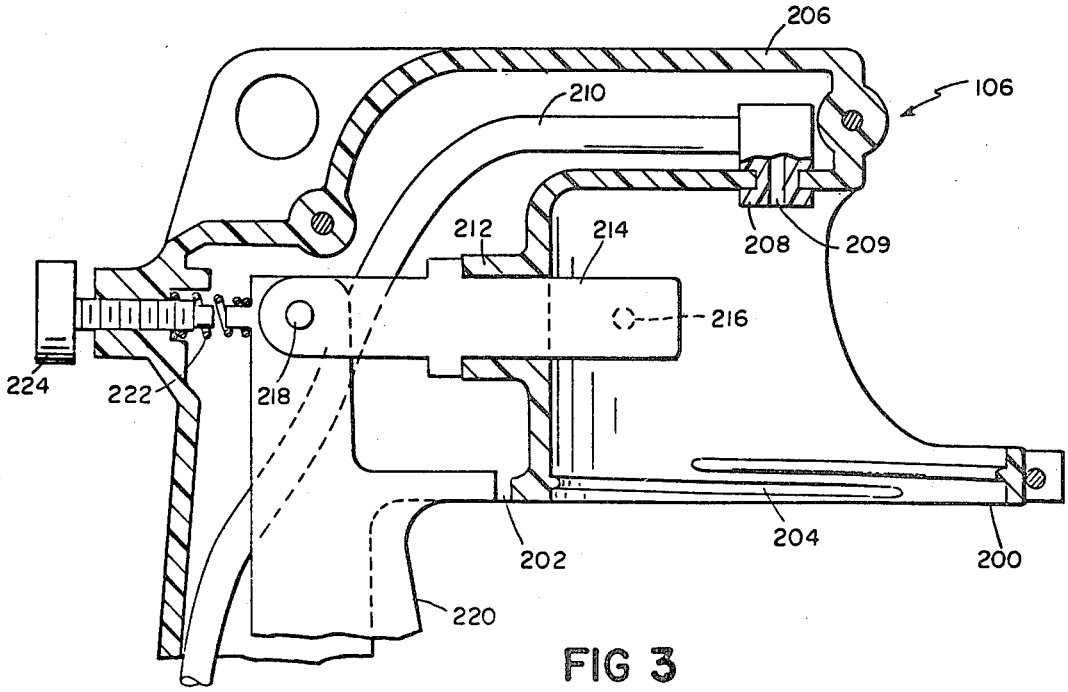
FIG 3

FIG 4
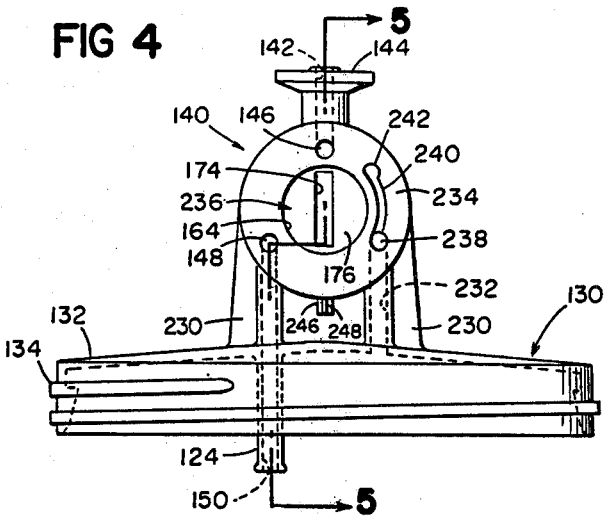
FIG 15
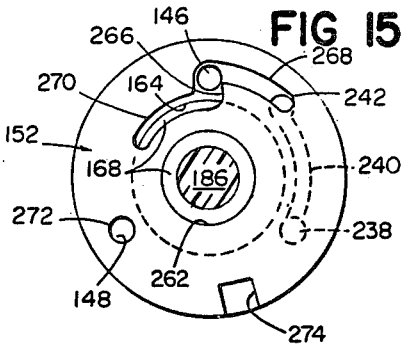
FIG 17
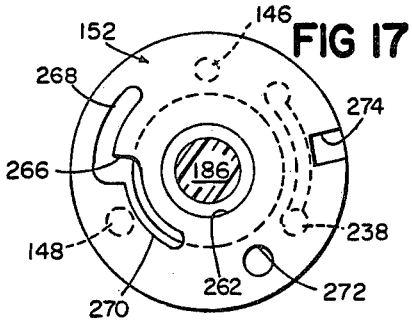
FIG 5
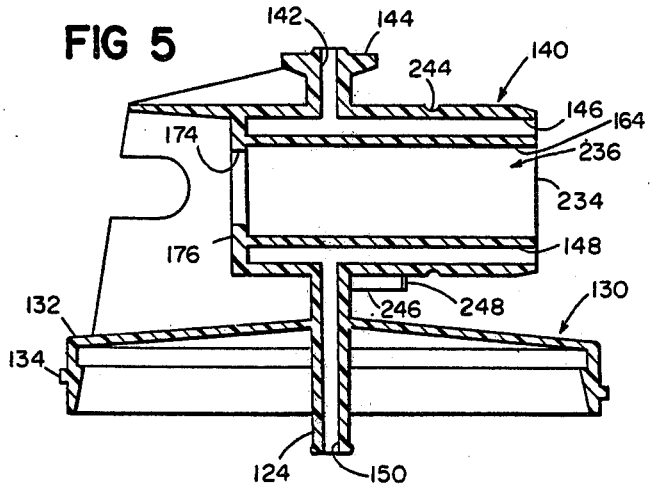
FIG 18
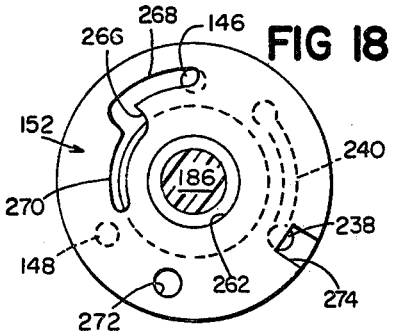
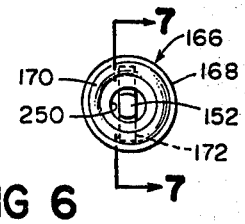
FIG 6
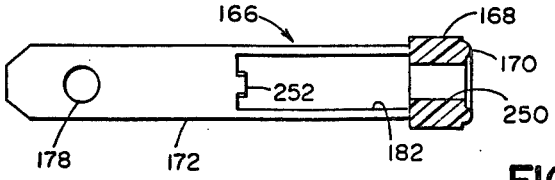
FIG 7
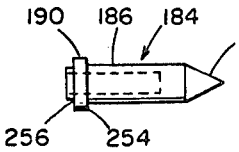
FIG 8

FIG 9
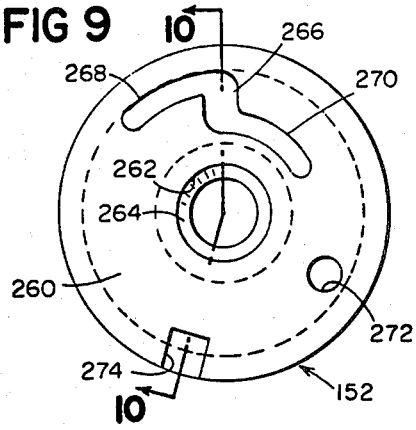
FIG 10
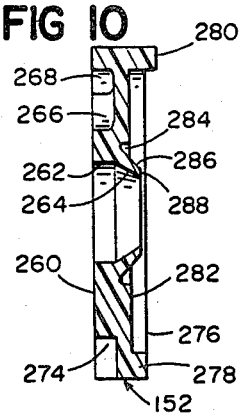
FIG 11
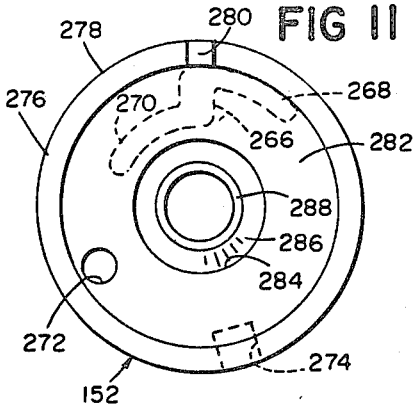
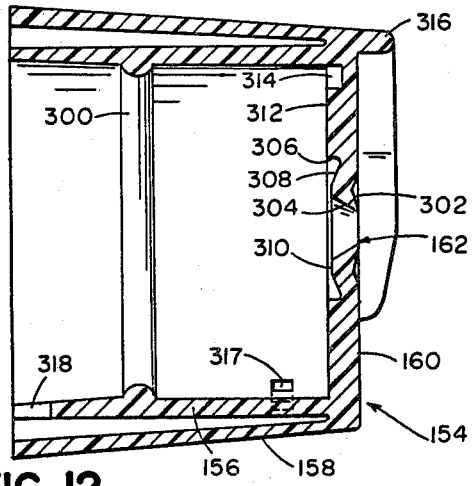
FIG 12
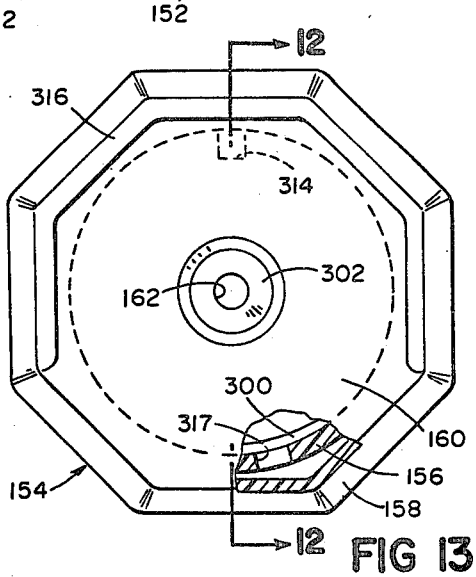
FIG 13
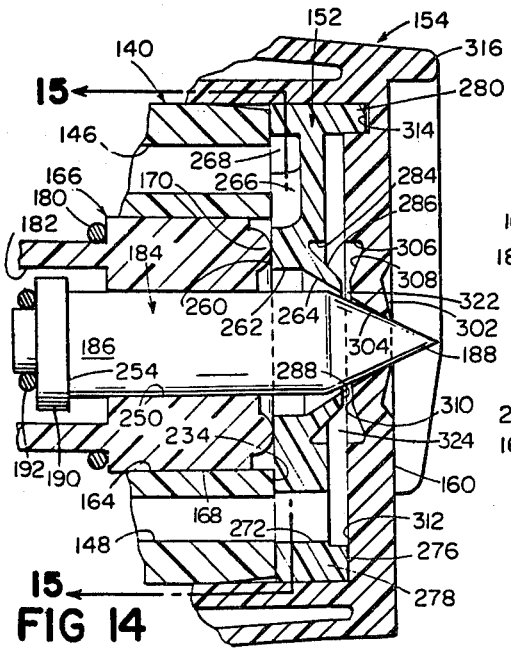
FIG 14
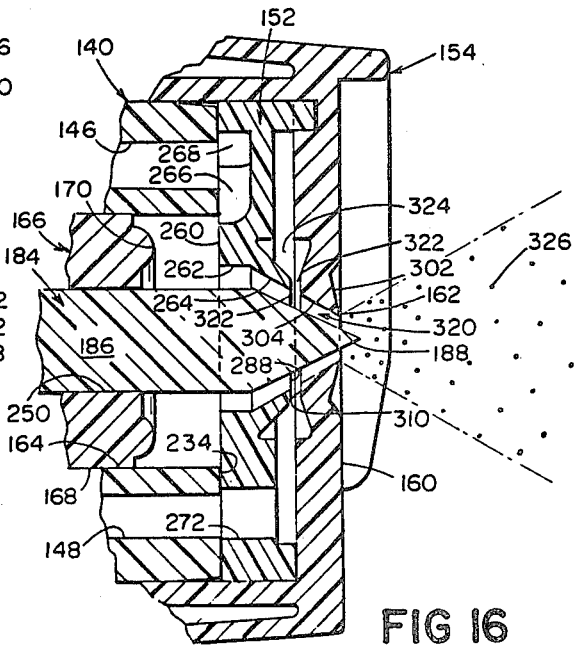
FIG 16

PLURAL VALVE, HAND-HELD SPRAY APPARATUS

BACKGROUND OF THE INVENTION

1. Field of the Invention

This invention relates to dispensing systems which, although of more general utility, are particularly suited for spraying liquids at low pressure from a hand-held spray device with container propulsion power source, such as a battery operated paint sprayer.

2. Description of the Prior Art

Hand-held dispensing apparatus of the prior art with self-contained propellant power sources have in general required large propellant power, such as gas pressure of the order of 70 p.s.i. provided by fluorocarbons, hydrocarbons or like propellants of the so-called aerosol type of such device in most general use. Devices using as the propellant air compressed by electrically operated compressors have generally also been designed to utilize high propellant gas pressure, with electric power requirements beyond the capacity of batteries suitable for inclusion in a hand-held spray device. Accordingly, such electrically-operated devices have had to suffer the disability of requiring connection to an external electric power source and/or compressor.

SUMMARY OF THE INVENTION

An object of this invention is to provide dispensing apparatus suitable for dispensing even viscous liquids, such as paint, in a spray of high droplet uniformity and confined regular pattern with the aid of only low gas propellant pressures, of the order of 4 p.s.i. or less, such as can readily be supplied by an electric compressor and operating batteries of size and weight suitable for containment in a hand-held spray device.

Another object is to provide novel and improved manually controllable dispensing apparatus.

Additional objects are to provide such a dispensing apparatus which operates satisfactorily at low volume flow of compressed air at the low pressures mentioned, which is conveniently manually controllable, and which may be made in small size and at low cost suitable for integral throw-away attachment to containers in which liquids to be sprayed are sold.

Dispensing apparatus in accordance with the invention has a body defining therein a tubular chamber with an outer wall of generally circular cross-section. A generally coaxial discharge orifice at an end of this chamber is closed by a first valve that includes a member of generally circular cross-section. That member also forms an inner chamber wall and defines with the outer chamber wall an annular discharge passage that is convergent towards the discharge orifice. An annular outlet is in one of the chamber walls and first passage means is arranged to supply liquid to be dispensed to the annular outlet for discharge into the discharge passage. Second passage means is provided for directing gas under pressure into the chamber for flow through the discharge passage, past the annular outlet and out the orifice. A second valve in the body seals the second passage from the chamber, and operator means is provided for operating the first and second valves concurrently to open the discharge orifice and to allow gas under pressure to flow through the discharge passage to transfer liquid from the annular outlet through the discharge orifice and form a spray of generally conical pattern.

In preferred embodiments, the dispensing apparatus is of small size and suitable for integral throw-away attachment to a container in which the liquid to be sprayed is sold. Preferably at least the cover for the liquid container is integral with the dispenser body, and in particular embodiments, the entire container and the dispensing head may be an integral unit. Such an integral unit may have a releasable coupling for attachment to a hand-held unit that includes a source of low pressure air such as a battery powered compressor and a manually operable control for operating the dispensing apparatus.

The dispensing apparatus, in a particular embodiment, includes a third valve in the dispenser body for closing the first passage means from the annular outlet. In that particular embodiment, the third valve includes a valve disc mounted for rotation with a valving surface for sealing the second passage from the container and the first passage from the annular outlet in a first disc position. The valve disc is rotatable to a second position in which both passages are open, and has an intermediate position in which the first passage is closed and the second passage is not blocked so that when the first and second valves are opened, gas under pressure flows through the discharge passage and the discharge orifice for cleaning or other purpose.

In a particular embodiment, the dispensing apparatus also includes a passage for applying pressurized gas to the liquid to be sprayed. The pressurized liquid flows through the first passage means to the annular outlet. The third valve also controls the flow of pressurized gas to the liquid. In that particular embodiment the liquid to be sprayed is stored in a compressible bag within a rigid container and the pressurized gas is applied to the exterior of the compressible bag, but it will be apparent that other liquid supply arrangements may be employed such as gravity flow or the use of an elongated dip tube and the application of pressure directly to the surface of liquid in a detachable container.

The preferred dispenser embodiment disclosed herein is also disclosed in copending application Ser. No. 816,487 filed July 18, 1977 of applicant Joseph Gerstmann. That application is directed to features of the spray nozzle and is filed contemporaneously herewith and assigned to the assignee of the present application.

A preferred dispensing nozzle configuration, suitable for spraying paint at a propellant gas pressure of 3 to 4 psi and flow rates of 0.3 to 0.9 cubic meter per hour may have a discharge orifice about 1.5 millimeter in diameter, that is defined by a sharp corner between an external bounding surface which forms an included angle toward the chamber of less than 110° with the chamber axis and an internal bounding surface of about 60° included angle. The annular outlet is in the outer wall and is spaced axially of the chamber from the discharge orifice between one half and three times the diameter of the discharge orifice. The discharge passage has a frusto-conical outer wall as an extension of that internal bounding surface, an annular outlet in that wall about 0.4 millimeter wide and spaced in the range 1–3 millimeters from the discharge orifice, and an axially movable member of the first valve that has a conical head with a smaller included angle than the outer wall. A liquid flow rate of about 45 cubic centimeters per minute with an air flow of about 0.85 cubic meter per hour and a pressure of about 4 psi has been found well suited for paint spray. Preferably the compressed gas, normally air, is directed in a generally linear flow directly towards the discharge orifice with substantially no angularity about the chamber axis. Observation indicates that the liquid to be sprayed flows from the annular outlet along the converging outer wall of the discharge passage and is in an annularly continuous thin film at the sharp corner of the discharge orifice. The liquid and the parallel flow of gas accelerate smoothly as they progress towards the discharge orifice through a discharge passage of decreasing area. As the liquid film passes the sharp corner of the discharge orifice, the pressurized gas flowing in parallel with the liquid abruptly expands through the liquid film and breaks up that film into droplets. This fragmentation of the thin liquid film forms a conical spray of droplets of small and uniform size.

BRIEF DESCRIPTION OF THE DRAWINGS

In the accompanying drawings:

FIG. 1 is a front elevation view (with parts broken away) of dispensing apparatus according to the invention;

FIG. 2 is a cross-section view taken along the line 2—2 of FIG. 1;

FIG. 3 is a cross-section view of a hand-held air supply and operator unit to which the dispenser unit of FIGS. 1 and 2 is releasably attachable;

FIG. 4 is a front elevation view of the dispenser body and container cover of the dispenser unit shown in FIG. 1;

FIG. 5 is a cross-section view taken along the line 5—5 of FIG. 4;

FIG. 6 is a front elevation view of an axially movable valve member employed in the dispenser unit shown in FIG. 1;

FIG. 7 is a cross-section view taken along the line 7—7 of FIG. 6;

FIG. 8 is a side elevation view of the discharge orifice valve member employed in the dispenser unit shown in FIG. 1;

FIG. 9 is a rear elevation view of a valve disc employed in the dispenser unit shown in FIG. 1;

FIG. 10 is a cross-section view taken along the line 10—10 of FIG. 9;

FIG. 11 is a front elevation view of the valve disc of FIG. 9;

FIG. 12 is a cross-section view taken along the line 12—12 of FIG. 13;

FIG. 13 is a front elevation view of the nozzle cap of the dispensing unit shown in FIG. 1;

FIG. 14 is an enlarged cross-section view of the discharge chamber of the dispensing unit of FIG. 1 showing the axially movable valve members in closed position and the rotary valve in open position;

FIG. 15 is a diagrammatic view taken along the line 15—15 of FIG. 14;

FIG. 16 is a view, similar to FIG. 14, with the axially movable valve members in open position for spraying paint; and FIGS. 17 and 18 are diagrammatic views, similar to FIG. 15, showing the rotary valve in a closed position and in an intermediate position respectively.

DESCRIPTION OF PARTICULAR EMBODIMENT

Shown in FIGS. 1 and 2 is a paint dispensing unit 100 of the throw-away type that includes a cylindrical container 102 and integral dispensing head unit 104. This replaceable unit is designed for releasable attachment to the hand-held operating unit 106 shown in FIG. 3. Container 102 includes a rigid outer can that has cylindrical side wall 108, bottom wall 110 secured to side wall 108 by bead 112, and upper wall 114 secured to side wall 108 by bead 116. Within the rigid can is a compressible bag 120 of flexible material that contains the liquid paint to be sprayed. Bag 120 has a neck portion 122 that is secured over depending stem 124 and extends through opening 126 in upper can wall 114. Dip tube 128 extends from stem 124 towards the bottom of bag 120. Formed integrally with, and surrounding, stem 124 is container cover 130 that has an annular flange 132 that is sealed to the annular bead 116 of container 102. A helical rib 134 is on the outer periphery of flange 132.

Integral with cover 130 and connected to stem 124 is dispensing head 104 which includes a housing member 140 with a gas inlet passage 142 and coupling flange 144 on its upper side. Formed in housing 140 is an axially extending gas flow passage 146 connected to gas inlet passage 142, and axially extending liquid flow passage 148 connected to the passage 150 through stem 124. A rotary valve disc 152 is seated on the front surface of the dispenser housing 140 and secured in position by nozzle cap 154 that includes a cylindrical sleeve 156, a protective skirt 158, and a front wall 160 in which is disposed discharge orifice 162.

Formed within housing 140 is a cylindrical chamber having a wall 164 in which is disposed a reciprocable member 166 (shown in greater detail in FIGS. 6 and 7) that has a cylindrical valve head 168 with an annular valve bead 170 on its front face and a rearwardly extending bar portion 172 which passes through aperture 174 in rear chamber wall 176. A coupling aperture 178 is provided in the rear end of bar portion 172. Spring 180 acts between rear chamber wall 176 and cylindrical head 168 to urge the valve bead 170 forward into sealing engagement with the rear surface of valve disc 152. Bar portion 172 has an aperture 182 and valve head 168 has a bore in which is disposed orifice valve member 184. That valve member has a cylindrical body 186, a conical nose 188 and a hub flange 190. Spring 192 acts between the rear wall of aperture 182 and hub flange 190 to urge valve member 184 forward so that its conical nose 188 extends through and closes discharge orifice 162.

The cooperating hand-held operating unit 106 shown in FIG. 3 includes a coupling ring 200 that extends forward from support frame 202. Formed in the inner surface of ring 200 is a helical rib 204. Above support ring 200 is cantilever arm 206 that carries a resilient coupling 208. A central bore 209 in coupling 208 is connected by tube line 210 to a battery powered compressor (not shown) that supplies compressed air at a pressure of about 4 p.s.i. Also formed in frame 202 is boss 212 that slidingly carries reciprocable link 214 which has a connecting pin 216 at its forward end and a pivot connection 218 to trigger 220 at its rear end. Trigger 220 and link 214 are biased forwardly by spring 222. Adjustment member 224 controllable limits the rearward movement of the trigger and link assembly.

The container-dispensing head unit 100 is attached to hand-held operating unit 106 by inserting the dispensing head 104 upwardly through ring 200 so that flange 144 is in alignment with resilient coupling 208 and angularly aligning helical ribs 132 and 204 to be in cooperating relation. The dispensing unit 100 is then rotated until link pin 216 enters and is latched in bar aperture 178. In this position, flange 144 is seated against resilient coupling 208, providing a seal between air supply line 210 and passage 142. The axially movable valve assembly of members 166 and 184 is coupled to trigger 220 by line 214 so that operation of the trigger moves orifice valve member 184 and cylindrical valve head 168 rearwardly to open the chamber valve and the discharge orifice valve.

The dispenser housing member shown in FIGS. 4 and 5 is of molded plastic. That housing member includes container cover 130 and the cylindrical housing body 140 connected by webs 230. Stem passage 150 passes through one web and a second passage 232 passes through a second web. The housing body 140 has a planar front face 234 with a central axially extending cylindrical chamber 236 defined by wall 164. Three axially extending passages 146, 148 and 238 extend rearwardly from front face 234. Also formed in front face 234 is an arcuate groove 240 that has an angular length of about 90°. One end of groove 240 is in communication with passage 238, the other end 242 of the groove has a width equal to the passage width, and the intermediate section of the groove 240 is of reduced width. Passage 146 is at the top of the cylindrical housing and in communication with air inlet passage 142; passage 148 is offset 120° from passage 146 and in communication with liquid supply passage 150; and passage 238, offset 120° from passage 148, is in communication with passage 232 that extends through cover 130. An annular groove 244 is formed in the other surface of housing 140, and a stop projection 246 with a detent 248 is at the base of the housing between the webs 230.

Valve member 166 is of molded plastic and has a length of about six centimeters or less and its head 168 has a diameter of about one centimeter or less. As shown in FIGS. 6 and 7, that valve member includes cylindrical head 168 with annular valve rib 170 formed on its front surface and a cylindrical through passage 250. Extending rearwardly from head 168 is elongated bar portion 172 of rectangular cross-section. Formed in bar portion 172 adjacent cylindrical head 168 is an elongated aperture 182 with a post 252 at its rear edge which defines a spring guide.

The orifice valve member 184 shown in FIG. 8 is also a molded plastic member and is about two centimeters or less in length with a cylindrical body portion 186 about ½ centimeter or less in diameter. Its conical nose 188 has an included angle of 50°. The hub 190 at the rear of body 186 has a front stop surface 254 and a rear spring seat surface 256.

The valve disc 152, shown in FIGS. 9–11, is a molded plastic member of about 4½ centimeters or less in diameter and about ⅛ centimeter in thickness. Its rear surface 260 seats on front surface 234 of housing 140. The disc has a central through passage that has a cylindrical section defined by surface 262 and a convergent section defined by frusto-conical surface 264 at an angle of 30° to the axis of disc 152. Formed in rear surface 260 at the upper side as shown in FIG. 9 is a recess that includes a central portion 266 that has a radial length of about ¾ centimeter, a first arcuate portion 268 that extends from the outer edge of central portion 266 and has an angular length of 45° and a second arcuate portion 270 that extends from the inner edge of central portion 266 in the opposite direction and has an angular extend of 60°. Through passage 272 is angularly offset by 120° from the central portion 266, and vent notch 274 that extends to the periphery of disc 152 is angularly offset from passage 272 by 75°. The front surface 276 of disc 152 is defined by rim 278. Projecting forwardly from rim 278 is tooth 280. Extending inwardly from rim 278 is a recessed planar surface 282 that terminates in annular groove 284. The inner wall 286 of groove 284 slopes inwardly and terminates at a planar rim surface 288 that is about 0.2 millimeter below surface 276.

The nozzle cap 154, also of molded plastic, is shown in FIGS. 12 and 13. That cap includes a cylindrical body section 156 that has an annular rib 300 formed on its inner surface that is adapted to be seated in annular groove 244 of housing 140 (FIG. 5), a skirt 158 of octagonal shape as indicated in FIGS. 1 and 13, and a front wall 160 in which discharge orifice 162 is provided. Orifice 162 is defined by the intersection of annular surfaces 302 and 304, surface 302 being disposed at an angle of 75° to the axis of cap 154 and surface 304 being disposed at an angle of 30° to that axis. Also formed in the rear surface of front wall 160 is an annular groove defined by cylindrical surface 306 and inclined surface 308 that terminates in annular rim surface 310 that extends to conical surface 304. Rim surface 310 is about 0.2 millimeter below the rear surface 312 of wall 160. At the upper edge of the surface 312 is a recess 314 which receives tooth 280 of valve disc 152. A forwardly projecting lip 316 is disposed above and on either side of discharge orifice 162 as an extension of skirt 158; a vent port 317 extends through body 156; and a limit slot 318 (about 90° in angular extent) is at the rear edge of body 156.

In assembly, valve disc 152 is inserted into the nozzle cap with tooth 280 in recess 314 and surface 278 seated on surface 312 as a first subassembly. Orifice valve 184 is inserted through bore 250 of valve member 166 and spring 192 is positioned between seats 252 and 256 so that the orifice valve 184 is urged forward and its hub surface 254 is seated against the rear surface of valve head 168. That valve subassembly, together with biasing spring 180 is inserted into the cylindrical cavity 236 of the housing body 140 with the rear end of bar 172 extending through aperture 174. The cap-valve disc subassembly is then inserted over the outer surface of housing 140 with rib 300 seated in groove 244. Indexing stop 246 is received in slot 318. In this position, the nozzle cap-valve disc subassembly may be rotated through 90° as limited by the engagement of projection 246 and slot 318.

An enlarged cross-section view of the dispensing nozzle is shown in FIG. 14 with the axially movable valves in closed position and the rotary valve in open position. Frusto-conical surfaces 264 and 304 are aligned and form the outer wall of a convergent discharge passage 320 that terminates at discharge orifice 162. Surfaces 288 and 310 define an annular opening 322 in the outer wall of the discharge passage which is in communication with an annular reservoir 324 defined by surfaces 284, 286, 306 and 308. An annular passage extends radially outward from reservoir 324 to port 272 in disc 152. In the open position of the rotary valve disc, as indicated in FIG. 15, port 272 is in alignment with passage 148. In that valve position, the central portion 266 of the groove is in alignment with air supply passage 146, groove arm 268 bridges the end 242 of groove 240 in housing face 234, and the inner portion of groove arm 270 bridges cylindrical surface 164. Thus low pressure air supplied through passage 146 is applied to the annular chamber surrounding valve bead 170 and, through groove 240 and passage 238 and 232 is applied through container cover 130 to pressurize the compressible bag 120 of paint. The pressurized paint flows upwardly through dip tube 128, stem passage 150 and axial passage 148 towards the annular reservoir 324 surrounding the discharge passage 320. No dispensing occurs as valves 170 and 188 are closed.

When trigger 220 is operated, valve member 166 is pulled rearwardly, separating valve bead 170 from disc surface 260, and allowing air to flow into the dispensing passage 320. The rear surface of valve cylinder 168 engages hub 190 of orifice valve 184 and moves that valve rearwardly, opening orifice 162. The dispensing nozzle with both axially movable valves in open position is shown in FIG. 16. In this position pressurized air flows through the convergent discharge passage 320 across the liquid paint at the annular outlet 322. The parallel flows of liquid paint and air accelerate smoothly as they move through the discharge passage towards the discharge orifice 162 with an annularly continuous thin film of paint at the sharp orifice edge defined by surfaces 302 and 304. As the film of paint exits orifice 162, the flowing gas expands abruptly through that film and forms a conical spray of paint droplets 236 of small and uniform size.

This dispensing action continues until trigger 220 is released. Springs 180, 192 and 222 move the valve members 166 and 184 forward, the discharge orifice 162 being closed when nose 188 seats against it and the air supply passage to the discharge passage 320 being closed when valve rib 170 seats against disc surface 260. In this condition, the paint in bag 120 is sealed from the atmosphere.

The nozzle cap 154 may be rotated 90° (counterclockwise as viewed in FIG. 1) to close the rotary valve. In that position, as indicated in FIG. 17, all three housing passages 146, 148 and 238 are closed by the valve disc 152. The nozzle cap may be located in an intermediate position (45° from the open position) as shown in FIG. 18. In that position, the end of groove arm 268 overlies air supply passage 146 so that pressurized air is supplied to the chamber surrounding valve rib 170; and the vent passage (notch 274 and port 317) is in communication with passage 238. The paint supply passage 148 is closed. In this intermediate position, the upper portion of container 102 is vented to atmosphere, relieving the pressure on bag 120. If trigger 220 is depressed, the ports closed by axially movable valve members 166 and 184 are opened and air flows through the dispensing passage 320 without flow of additional paint from bag 120, thereby permitting the nozzle passage to be cleared of any residual paint.

Other embodiments are within the scope of the invention and claims.

What is claimed is:

1. Dispensing apparatus comprising a body defining a tubular dispensing chamber having an outer chamber wall of generally circular cross-section;

a discharge orifice at one end of said chamber generally coaxial thereto;

a first valve in said chamber for closing said discharge orifice, said first valve including a member of generally circular cross-section and forming an inner chamber wall that defines with said outer chamber wall an annular discharge passage that is convergent towards said discharge orifice;

an annular port in one of said chamber walls surrounding the axis of said chamber;

a gas passage in said chamber upstream of said annular port;

first passage means arranged to supply liquid to be dispensed to said annular port for discharge into said discharge passage;

second passage means for directing gas under pressure into said chamber through said gas passage for flow through said discharge passage past said annular port and out said discharge orifice;

a second valve in said body for sealing said second port;

and operator means for operating said first and second valves concurrently to open said discharge orifice and to allow gas under pressure to flow through said discharge passage to transfer liquid from said annular port through said discharge orifice and form spray of generally conical pattern.

2. Dispensing apparatus according to claim 1 and further including a third valve in said body for closing said first passage means from said annular port.

3. Dispensing apparatus according to claim 2 wherein said third valve includes a valve member mounted for rotation about the axis of said dispensing chamber.

4. Dispensing apparatus according to claim 3 wherein said rotatable valve member includes a valving surface for sealing said second passage means from said chamber.

5. Dispensing apparatus according claim 4 wherein said rotatable valve member is a disc and an axially movable member of said second valve is seated against a surface of said disc in a closed position.

6. Dispensing apparatus according to claim 5 and further including third passage means through said cover for directing gas from said second passage means to pressurize the liquid to be sprayed for flow through said first passage means to said annular port.

7. Dispensing apparatus according to claim 1 and further including third passage means for directing gas from said second passage means to pressurize the liquid to be sprayed for flow through said first passage means to said annular port.

8. Dispensing apparatus according to claim 1 wherein said operator means includes a releasable connector for attachment to an actuator device of the hand-held type.

9. Dispensing apparatus according to claim 1 and further including a releasable coupling on said body for connecting said second passage means to a source of low pressure gas.

10. Dispensing apparatus according to claim 9 wherein said operator means includes a releasable connector, said connector and said coupling being arranged for attachment to an actuator device of the hand-held type.

11. Dispensing apparatus according to claim 1 wherein said discharge orifice is defined by a sharp corner between a first bounding surface externally of said chamber which forms an included angle towards the chamber with the axis of said chamber of less than 110° and a second bounding surface internal of said chamber which forms an included angle with said first bounding surface of less than 80°, and said annular outlet is in said outer wall and spaced axially of said chamber from said orifice between one half and three times the diameter of said orifice.

12. Dispensing apparatus according to claim 11 wherein said operator means includes a releasable connector for attachment to an actuator device of the hand-held type.

13. Dispensing apparatus comprising a body defining a tubular dispensing chamber having an outer chamber wall of generally circular cross-section;

a discharge orifice at one end of said chamber generally coaxial thereto;

a first valve in said chamber for closing said discharge orifice, said first valve including a member of generally circular cross-section and forming an inner chamber wall that defines with said outer chamber wall an annular discharge passage that is convergent towards said discharge orifice, said member of said first valve including a conical nose of smaller included angle than said chamber outer wall and being movable axially of said chamber between a first position closing said discharge orifice and a second position providing said gas flow through said discharge orifice, an annular outlet in one of said chamber walls surrounding the axis of said chamber, an inlet port in said chamber on the side of said annular outlet away from said discharge orifice, first passage means arranged to supply liquid to be dispensed to said annular outlet for discharge into said discharge passage;

second passage means for directing gas under pressure into said chamber for flow through said discharge passage past said annular outlet and out said discharge orifice;

a second valve in said body for sealing said second passage means from said chamber;

a member of said second valve being movable axially of said chamber between a first position closing said inlet port and a second position providing gas flow through said inlet port, said valve members of said first and second valves being coupled together for concurrent axial movement to open said discharge orifice and said inlet port, and operator means for operating said first and second valves concurrently to open said discharge orifice and to allow gas under pressure to flow through said discharge passage to transfer liquid from said annular outlet through said discharge orifice and form spray of generally conical pattern.

14. Dispensing apparatus comprising a body defining a tubular dispensing chamber having an outer chamber wall of generally circular cross-section;

a discharge orifice at one end of said chamber generally coaxial thereto, said discharge orifice being defined by a sharp corner between a first bounding surface externally of said chamber which forms an included angle towards the chamber with the axis of said chamber of less than 110° and a second bounding surface internal of said chamber which forms an included angle with said first bounding surface of less than 80°, a first valve in said chamber for closing said discharge orifice, said first valve including a member of generally circular cross-section and forming an inner chamber wall that defines with said outer chamber wall an annular discharge passage that is convergent towards said discharge orifice, said member of said first valve including a conical nose of smaller included angle than said chamber outer wall and being movable axially of said chamber between a first position closing said discharge orifice and a second position providing said gas flow through said discharge orifice, an annular outlet in said outer chamber wall and spaced axially of said dispensing chamber from said discharge orifice between one half and three times the diameter of said discharge orifice, an inlet port in said chamber on the side of said annular outlet away from said discharge orifice, first passage means arranged to supply liquid to be dispensed to said annular outlet for discharge into said discharge passage;

second passage means for directing gas under pressure into said chamber for flow through said discharge passage past said annular outlet and out said discharge orifice;

a second valve in said body for sealing said second passage means from said chamber;

a member of said second valve being movable axially of said chamber between a first position closing said inlet port and a second position providing gas flow through said inlet port, said valve members of said first and second valves being coupled together for concurrent axial movement to open said discharge orifice and said inlet port, and operator means for operating said first and second valves concurrently to open said discharge orifice and to allow gas under pressure to flow through said discharge passage to transfer liquid from said annular outlet through said discharge orifice and form spray of generally conical pattern, said operator means including a releasable connector for attachment to an actuator device of the hand-held type.

15. Dispensing apparatus according to claim 14 and further including a third valve in said body, said third valve including a valve member that is mounted for rotation and that has valving surfaces for closing said second passage means from said chamber and for closing said first passage means from said annular outlet in a first position and for opening said first and second passages in a second valve position.

16. Dispensing apparatus according to claim 15 and further including a releasable coupling on said body for connecting said second passage means to a source of low pressure gas.

17. Dispensing apparatus according to claim 16 and further including third passage means for directing gas from said second passage means to pressurize the liquid to be sprayed for flow through said first passage means to said annular outlet.

18. Dispensing apparatus according to claim 17 and further including a rigid container and a compressible bag within said rigid container for storing the liquid to be sprayed, said third passage being connected to said rigid container to apply pressurized gas to the exterior of said compressible bag.

* * * * *